US009770142B2

(12) United States Patent
Ochoa, Sr. et al.

(10) Patent No.: US 9,770,142 B2
(45) Date of Patent: Sep. 26, 2017

(54) MULTI-PIECE SUPPORT FOR PAPER ROLL PRODUCT

(71) Applicant: DISPENSING DYNAMICS INTERNATIONAL, City of Industry, CA (US)

(72) Inventors: Orlando Pedro Ochoa, Sr., Walnut, CA (US); Charles Parkin Davis, Torrance, CA (US)

(73) Assignee: Dispensing Dynamics International, LLC, City of Industry, CA (US)

( * ) Notice: Subject to any disclaimer, the term of this patent is extended or adjusted under 35 U.S.C. 154(b) by 408 days.

(21) Appl. No.: 14/094,017

(22) Filed: Dec. 2, 2013

(65) Prior Publication Data

US 2015/0150422 A1 Jun. 4, 2015

(51) Int. Cl.

| | |
|---|---|
| ***A47K 10/16*** | (2006.01) |
| ***B65H 75/18*** | (2006.01) |
| *B65H 75/24* | (2006.01) |

(52) U.S. Cl.

CPC ..... *A47K 10/16* (2013.01); *B65H 75/185* (2013.01); *B65H 75/242* (2013.01)

(58) Field of Classification Search

CPC .... B65H 75/185; B65H 75/242; A47K 10/40; A47K 10/16

USPC ..... 242/596.7

See application file for complete search history.

(56) References Cited

U.S. PATENT DOCUMENTS

| | | | | | |
|---|---|---|---|---|---|
| 2,049,334 | A * | 7/1936 | Sobota | B65H 75/14 | 242/118.61 |
| 2,269,939 | A * | 1/1942 | Janisch | B65H 75/185 | 242/612 |
| 2,280,370 | A * | 4/1942 | Bennett | B65H 75/242 | 242/573.1 |
| 2,556,684 | A * | 6/1951 | De Santis | D01H 1/183 | 242/130.2 |
| 2,928,619 | A * | 3/1960 | Burton | A47K 10/38 | 242/118.61 |
| 3,157,405 | A * | 11/1964 | Hafemeister | B23B 31/404 | 242/571.3 |
| 3,438,589 | A * | 4/1969 | Jespersen | A47K 10/16 | 206/408 |
| 3,519,216 | A * | 7/1970 | Rienzi | B65H 75/185 | 242/599.2 |
| 3,615,063 | A * | 10/1971 | Bates | B65H 75/185 | 242/611.2 |
| 3,998,120 | A * | 12/1976 | Granger | A47K 10/40 | 83/335 |
| 4,021,004 | A * | 5/1977 | Poteat | B65H 75/14 | 242/118.6 |
| 4,141,517 | A * | 2/1979 | Olcer | B65H 16/04 | 242/573.6 |
| 4,149,682 | A * | 4/1979 | Gustafson | B66C 1/54 | 242/571.3 |
| 4,553,710 | A * | 11/1985 | Pool | A47K 10/40 | 242/596.4 |

(Continued)

*Primary Examiner* — Emmanuel M Marcelo
*Assistant Examiner* — Michael Gallion
(74) *Attorney, Agent, or Firm* — Thomas R. Lampe

(57) ABSTRACT

A paper roll end support plug includes a first plug member non-rotatably mounted on a dispenser and a second plug member inserted in the paper roll end and rotatable relative to the first plug member, the plug members being in frictional engagement to prevent overspin of the paper roll during dispensing of paper from the roll.

10 Claims, 9 Drawing Sheets

(56) References Cited

U.S. PATENT DOCUMENTS 4,600,163 A * 7/1986 Hummel ..... B65B 67/085 242/422.1
4,694,559 A * 9/1987 Lundy ..... B65H 75/242 242/571.3
5,492,280 A * 2/1996 Corres ..... B65H 49/06 242/129.5
5,626,309 A * 5/1997 Morgan ..... B65H 49/06 242/130.1
5,979,823 A * 11/1999 Schlumpf ..... B65H 75/242 242/571.2
5,988,561 A * 11/1999 Mele ..... A47K 10/40 242/599.1
6,027,069 A * 2/2000 Huang ..... B65B 67/085 242/588.2
6,138,941 A * 10/2000 Miyake ..... G03B 27/588 206/397
6,182,921 B1 * 2/2001 Muylle ..... B65H 75/185 242/118.61
6,361,229 B1 * 3/2002 Shinga ..... B65H 16/08 160/323.1
6,375,116 B1 * 4/2002 Askins ..... B65H 75/185 242/599.2
6,390,428 B1 * 5/2002 Oshima ..... B41L 13/00 242/613.4
6,439,501 B1 * 8/2002 Harmathy ..... A47K 10/38 242/565
6,446,901 B1 * 9/2002 Haen ..... A47K 10/36 225/12
6,874,958 B1 * 4/2005 Panebianco ..... B41J 15/02 242/358.1
7,191,979 B2 * 3/2007 Paukov ..... B65H 75/185 242/578.2
7,350,463 B2 * 4/2008 Blanchard, Jr. ..... B41J 2/325 101/407.1
7,537,180 B2 * 5/2009 Morand ..... A47K 10/40 242/596.7
7,828,240 B2 * 11/2010 Hagleitner ..... A47K 10/38 242/598.3
7,905,444 B2 * 3/2011 Chen ..... B41J 35/28 242/571.3
8,033,496 B2 * 10/2011 Murase ..... B65H 75/242 242/573
8,308,102 B2 * 11/2012 Lin ..... B65H 75/12 242/597.6
8,578,826 B2 * 11/2013 Hansen ..... A47K 10/36 83/337
8,783,600 B1 * 7/2014 Myron ..... A47K 10/16 242/596.7
2003/0173451 A1 * 9/2003 Inana ..... B65H 16/06 242/578.2
2004/0144883 A1 * 7/2004 Adler ..... A47K 10/40 242/598.3
2004/0245368 A1 * 12/2004 Kewin ..... B65H 75/185 242/613.5
2007/0040060 A1 * 2/2007 Dedeken ..... B65H 18/04 242/571.6
2011/0114778 A1 * 5/2011 Andersson ..... A47K 10/40 242/160.1
2012/0032021 A1 * 2/2012 Morinaga ..... B65H 75/08 242/577
2013/0072366 A1 * 3/2013 Lai ..... B65H 75/08 492/47
2013/0087652 A1 * 4/2013 Chastain ..... B65H 49/322 242/588.3
2015/0166285 A1 * 6/2015 Stanton ..... B65H 16/005 242/422
2015/0183542 A1 * 7/2015 Blok ..... B65B 67/085 242/358
2015/0305578 A1 * 10/2015 Keily ..... A47K 10/36 242/419.9

* cited by examiner

MULTI-PIECE SUPPORT FOR PAPER ROLL PRODUCT

TECHNICAL FIELD

This invention relates to a multi-piece support for paper roll products and more particularly to a roll end support plug connectable to a roll support of a paper product dispenser for supporting an end of a rotatable paper roll.

BACKGROUND OF THE INVENTION

Core plugs have been used with rolls of paper toweling and the like for many years. Such arrangements are conventionally of single piece construction and are often used to ensure that a roll of product can be utilized with specific dispensers. Exemplary core plugs are shown in U.S. Pat. Nos. 7,191,979 and 7,537,180. If a customer tries to use a universal toweling roll without the core plug, the roll will either fall off of the roll supports or dispensing of the product will be greatly degraded.

Conventional core plugs can have a number of disadvantages. For example, roll overspin can occur. That is, during dispensing of the product from a dispenser the supply roll of paper product can rotate too far and interfere with continued dispensing of the product. Overspin can create negative dispensing issues especially when the dispensers incorporate self-cutting mechanisms, such as drum mounted tear blade systems. One adverse result is double sheeting. On fast pulls by a user of the dispenser the drum can over-rotate, dispensing the next sheet still attached to the first. Furthermore, the overspun toweling has no tension against the tear blade which can reduce cutting effectiveness. Tabbing is another undesirable result. Due to shock force in the toweling created by a subsequent user to get the roll spinning, tab portions of the lead end of the toweling will break away. The shock force can also reduce tail length if it occurs after the cut is made by a dispenser blade.

DISCLOSURE OF INVENTION

The present invention encompasses a roll end support plug of unique character which provides overspin control through friction occurring between inner and outer plug members of the support plug. Resin selection can be used to tune a desired amount of friction. The amount of friction is proportional to the weight of the product roll and is highest with a full roll and diminishes as the roll is exhausted. In general, when utilizing prior art support plugs overspin is most likely to occur with full rolls and diminish as the moment of inertia decreases with roll exhaustion.

In addition, the support plug of the present invention allows flush mounting on a paper product roll. This eliminates the need for extra pads in the shipping case for the rolls. Many core plugs or supports have a male projection which extends from the roll towel. This projection must be protected in the paper case to protect the plug during shipping and stacking. Plugs of this nature use and require a slotted cardboard pad that rests on top of the roll to carry the stacking loads, keeping the loads off of the core plug. This necessity no longer exists with the flush roll mounting provided by the support plug of the present invention.

As described in greater detail below, the roll end support plug of the present invention includes first and second plug members, one attached to a roll support of a dispenser and the other affixed to an end of a roll product and rotatable with the roll product relative to the plug member attached to the dispenser roll support. This results in reduced wear of dispenser roll supports because instead of having a spinning hub roll support, that wear is transferred to the spinning core plug member which only has to last the life of one roll whereas the dispenser is expected to last for many hundreds of rolls.

The roll end support plug of the present invention is connectable to a roll support of a paper product dispenser for supporting an end of a rotatable paper roll comprised of wound toweling or tissue defining an elongated central paper roll opening extending the length thereof.

The support plug includes a first plug member for attachment to a dispenser roll support with the first plug member non-rotatable relative to the dispenser roll support.

A second plug member is positionable in the elongated central paper roll opening and is rotatably mounted on the first plug member and in frictional engagement with the first plug member to resist rotation of the second plug member and the paper roll attached thereto to prevent overspin of the paper roll when paper product is dispensed from the paper product dispenser. Other features, advantages and objects of the present invention will become apparent with reference to the following description and accompanying drawings.

MODES FOR CARRYING OUT THE INVENTION

Figure 1:
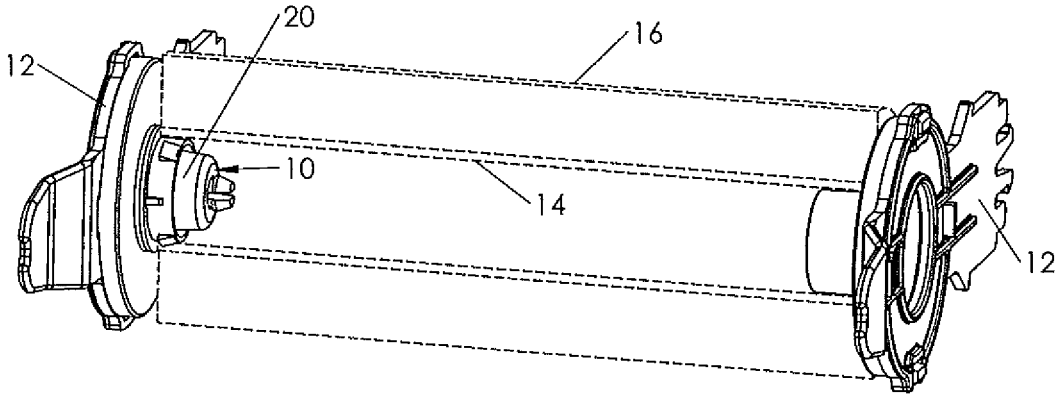
FIG. 1 is a perspective view illustrating a first embodiment of roll and support plug of this invention mounted on one of a pair of dispenser roll support arms, the roll and support arm inserted into a core of a paper towel roll shown in dash lines.
Figure 2:
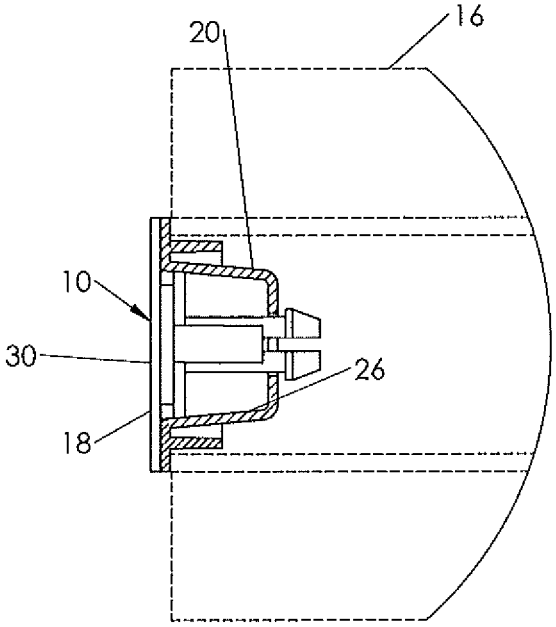
FIG. 2 is a detailed, cross-sectional view of the first embodiment.
Figure 3:
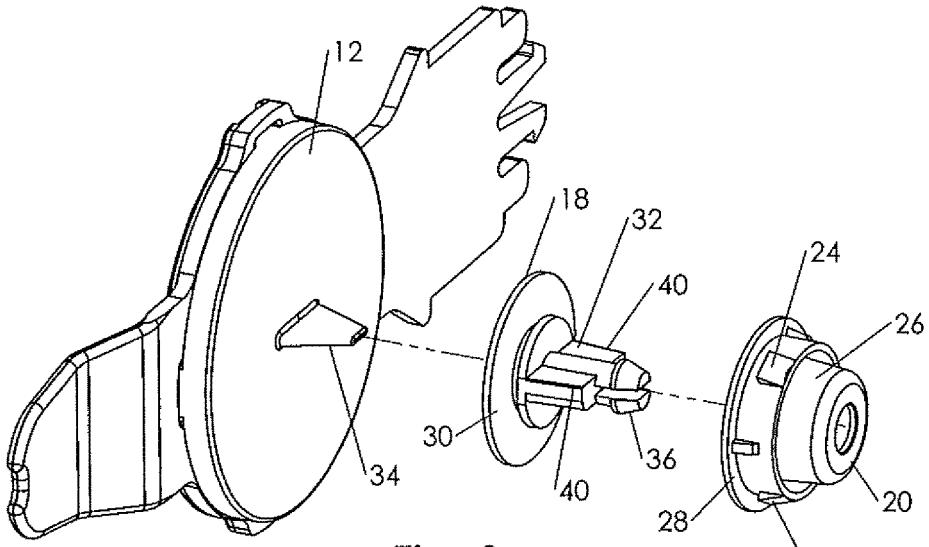
FIG. 3 is an exploded, perspective view showing the two plug members of the support plug separated and prior to installation of the support plug on a dispenser support arm.
Figure 4:
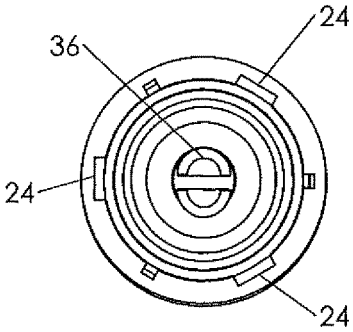
FIG. 4 is an elevational view of an end of the assembled first embodiment support plug.
Figure 5:
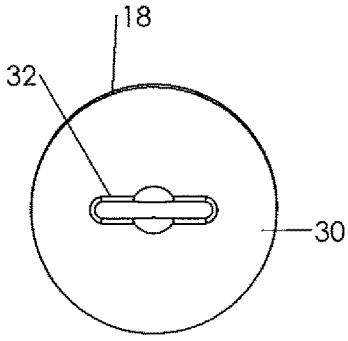
FIG. 5 is a view similar to FIG. 4, but illustrating the other end of the assembled support plug of the first embodiment.
Figure 6:
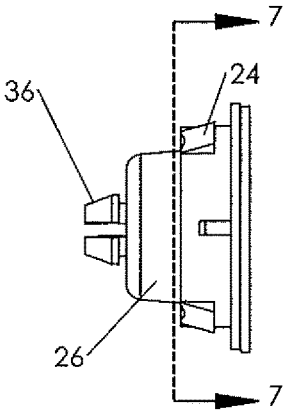
FIG. 6 is a side, elevational view of the assembled first embodiment support plug.
Figure 7:
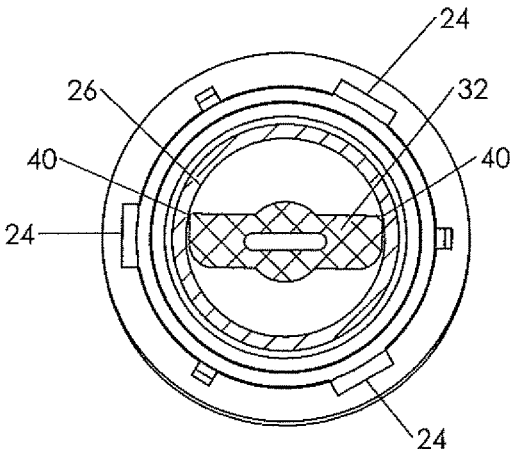
FIG. 7 is a cross-sectional view taken along line 7-7 of FIG. 6.
Figure 8:
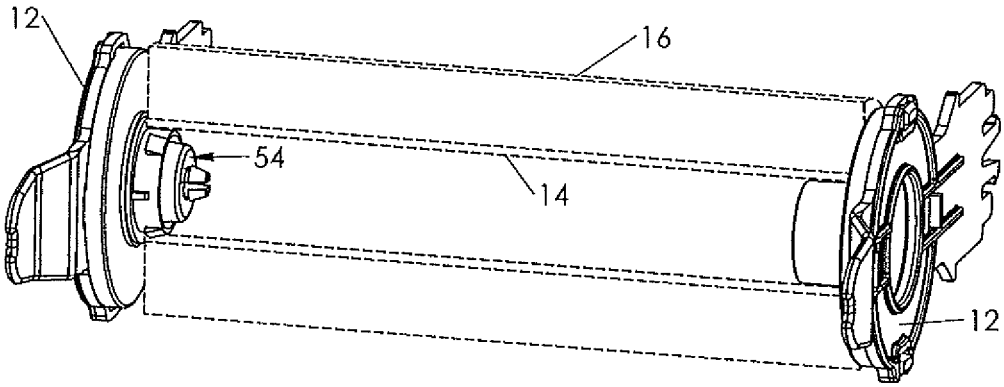
FIG. 8 is a view similar to FIG. 1, but illustrating a second embodiment of the support plug.
Figure 9:
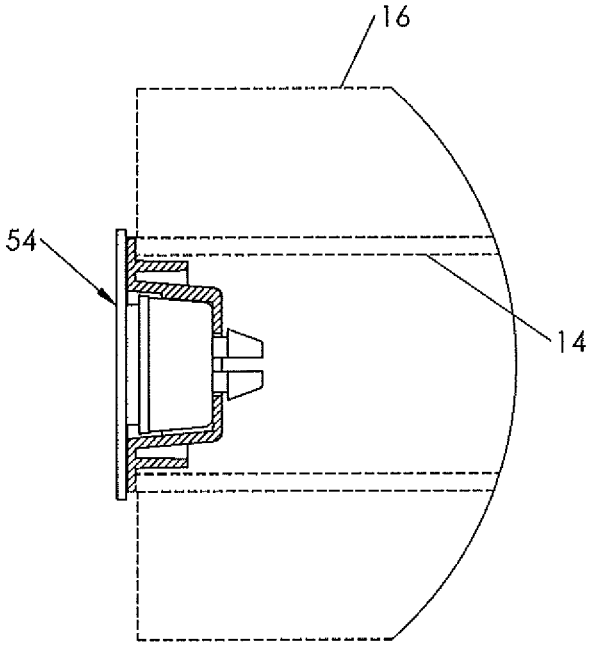
FIG. 9 is a view similar to FIG. 2 showing the second embodiment.
Figure 10:
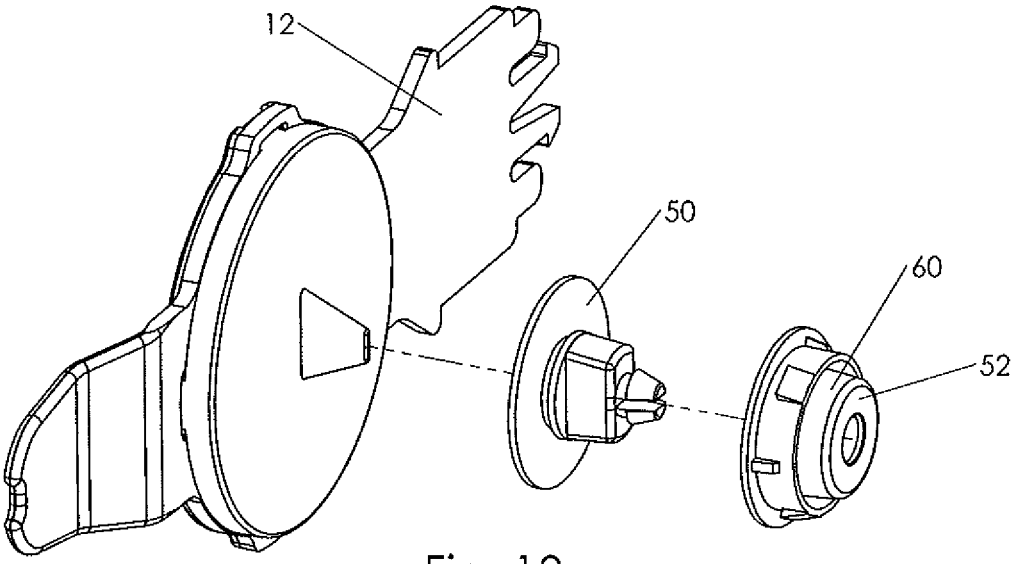
FIG. 10 is a view similar to FIG. 3, but illustrating the second embodiment.
Figure 11:
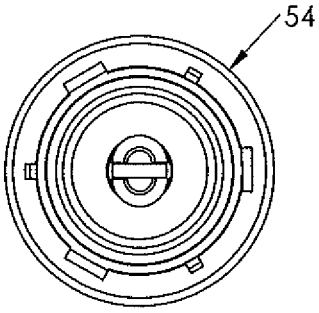
FIG. 11 is a view similar to FIG. 4, but illustrating the second embodiment.
Figure 12:
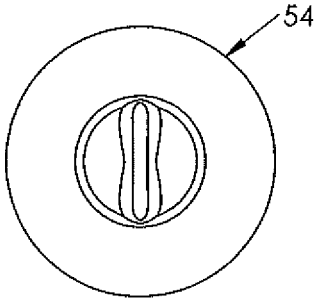
FIG. 12 is a view similar to FIG. 5, but illustrating the second embodiment.
Figure 13:
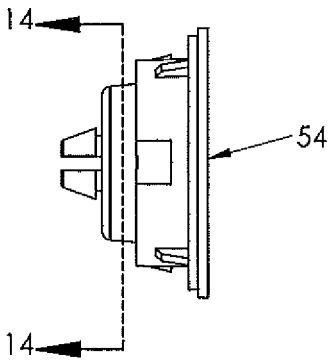
FIG. 13 is a view similar to FIG. 6, but illustrating the second embodiment.
Figure 14:
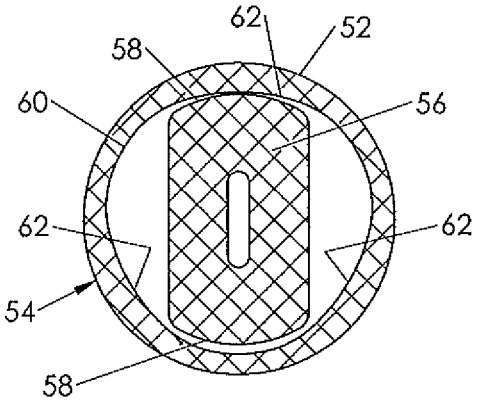
FIG. 14 is a view similar to FIG. 7, but illustrating the second embodiment.
Figure 15:
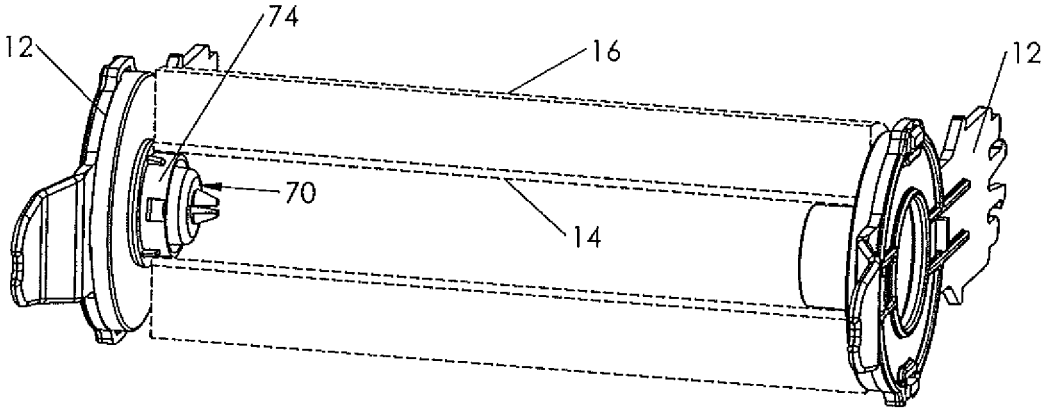
FIG. 15 is a view similar to FIG. 1, but illustrating a third embodiment.
Figure 16:
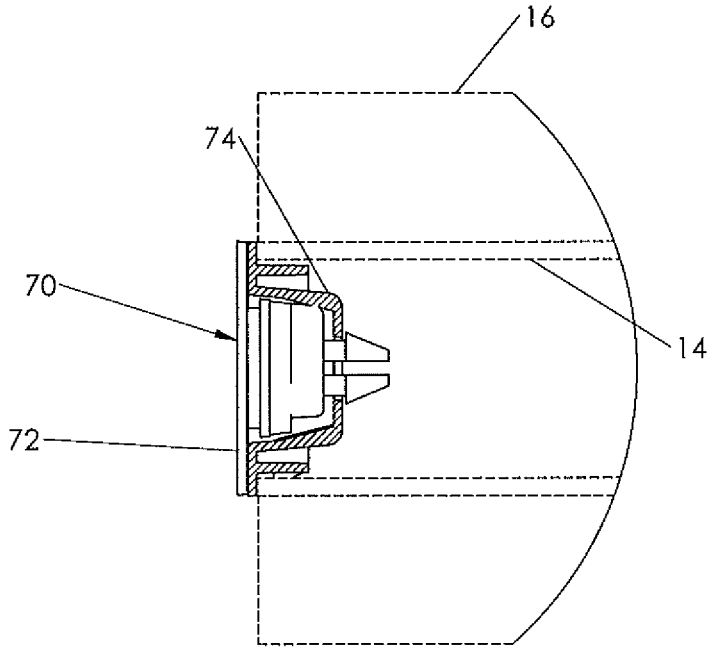
FIG. 16 is a view similar to FIG. 2, but illustrating the third embodiment.
Figure 17:
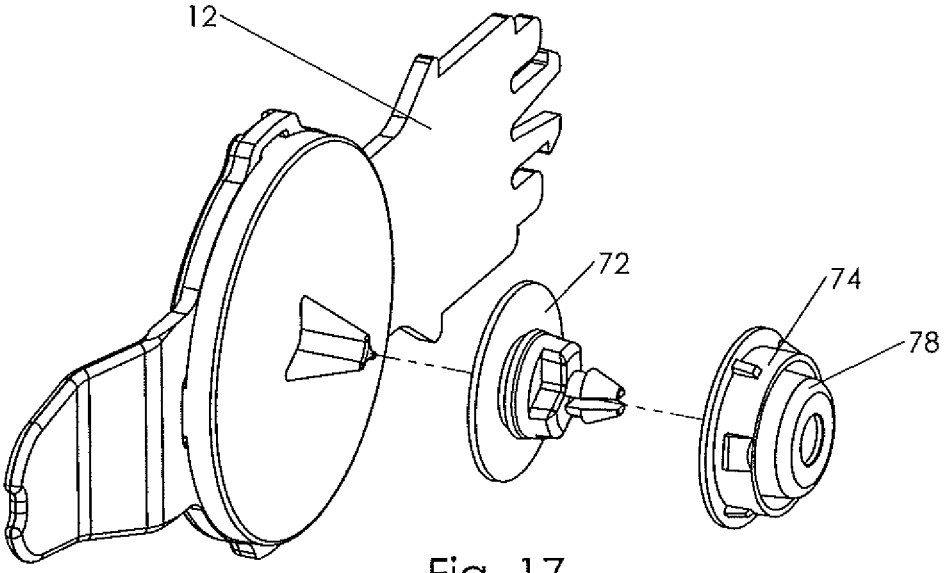
FIG. 17 is a view similar to FIG. 3, but illustrating the third embodiment.
Figure 18:
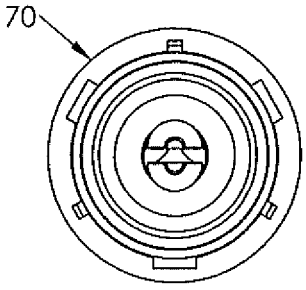
FIG. 18 is a view similar to FIG. 4, but illustrating the third embodiment.
Figure 19:
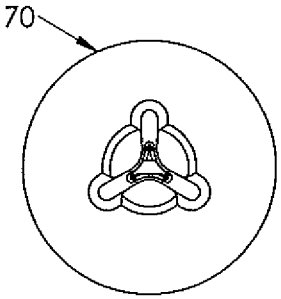
FIG. 19 is a view similar to FIG. 5, but illustrating the third embodiment.
Figure 20:
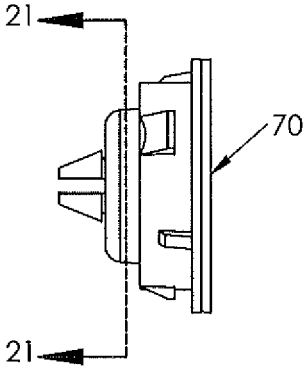
FIG. 20 is a view similar to FIG. 6, but illustrating the third embodiment.
Figure 21:
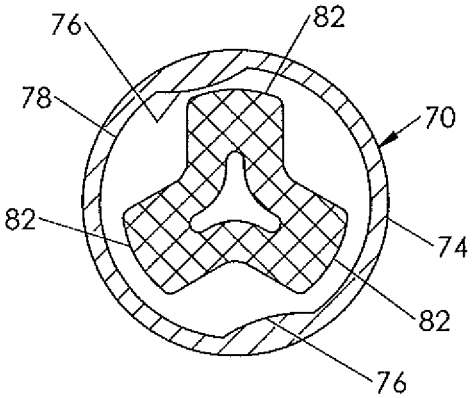
FIG. 21 is a view similar to FIG. 7, but illustrating the third embodiment.
Figure 22:
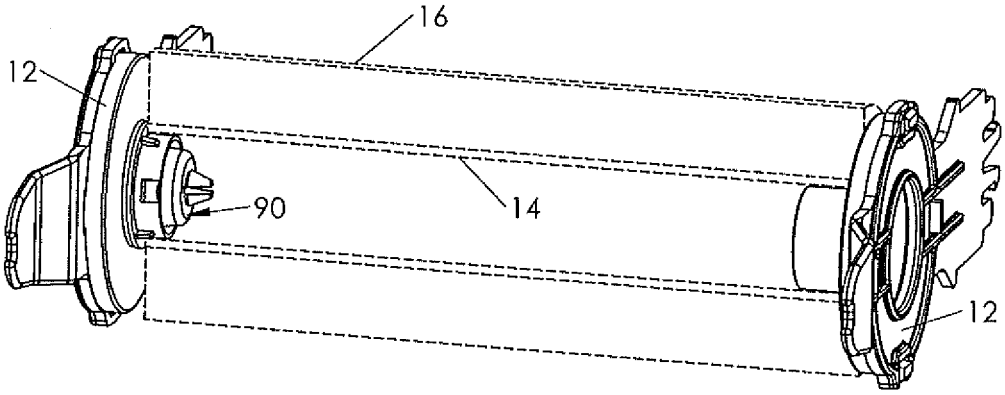
FIG. 22 is a view similar to FIG. 1, but illustrating a fourth embodiment.
Figure 23:
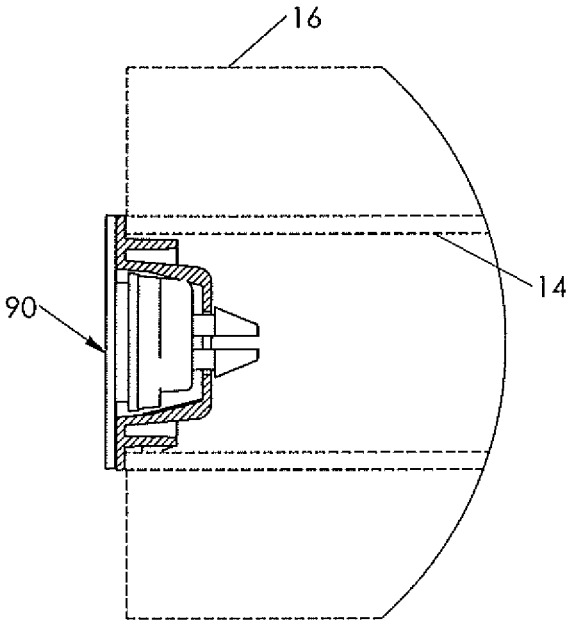
FIG. 23 is a view similar to FIG. 2, but illustrating the fourth embodiment.
Figure 24:
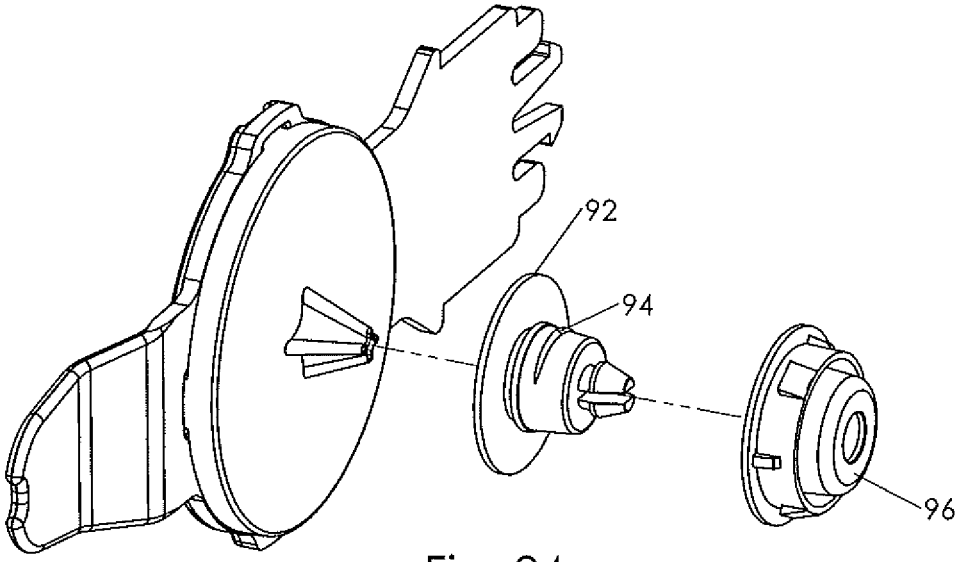
FIG. 24 is a view similar to FIG. 3, but illustrating the fourth embodiment.
Figure 25:
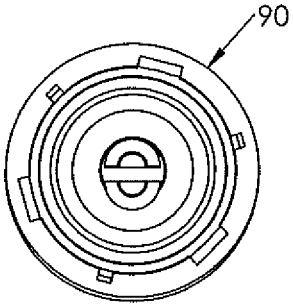
FIG. 25 is a view similar to FIG. 4, but illustrating the fourth embodiment.
Figure 26:
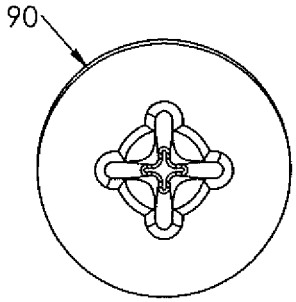
FIG. 26 is a view similar to FIG. 5, but illustrating the fourth embodiment.
Figure 27:
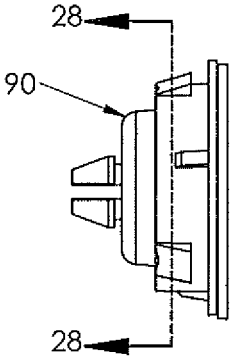
FIG. 27 is a view similar to FIG. 6, but illustrating the fourth embodiment.
Figure 28:
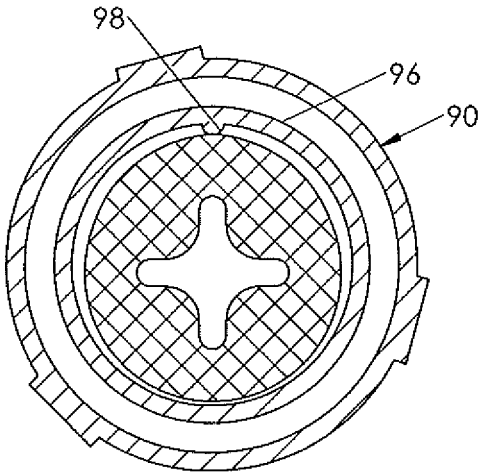
FIG. 28 is a view similar to FIG. 7, but illustrating the fourth embodiment.
Figure 29:
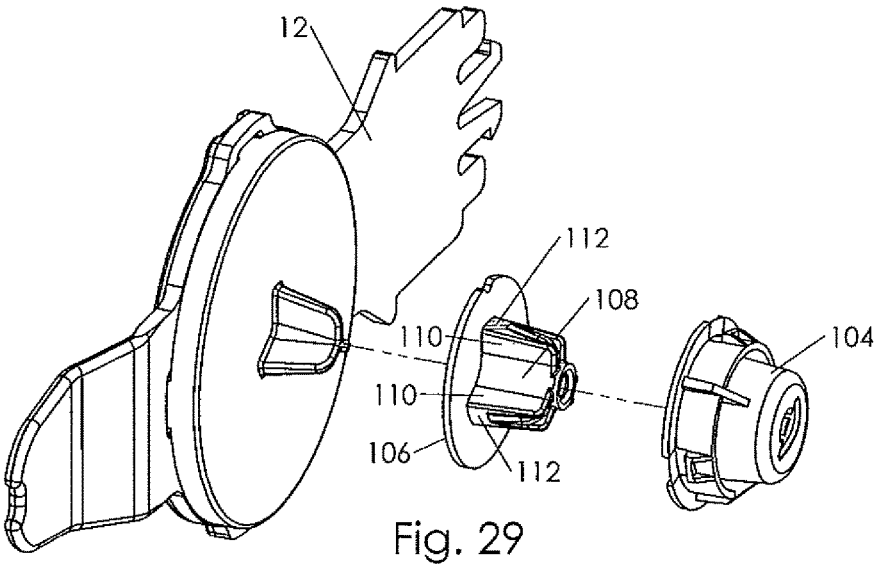
FIG. 29 is a view similar to FIG. 3, but illustrating a fifth embodiment.
Figure 30:
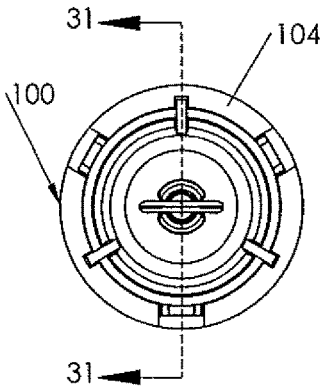
FIG. 30 is a view similar to FIG. 4, but illustrating the fifth embodiment.
Figure 31:
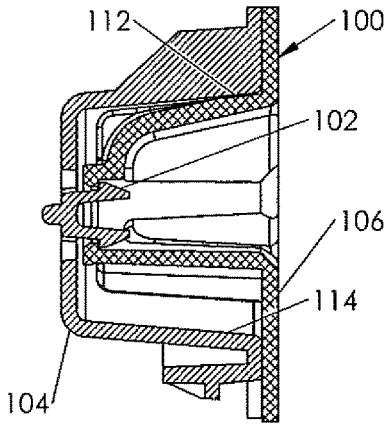
FIG. 31 is an enlarged, cross-sectional view of the fifth embodiment taken along line 31-31 of FIG. 30.
Figure 32:
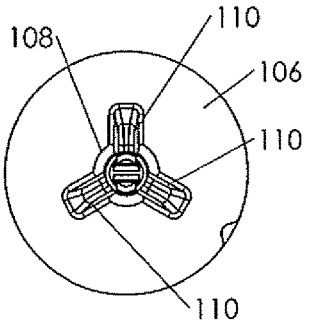
FIG. 32 is a view similar to FIG. 5, but illustrating the fifth embodiment.
Figure 33:
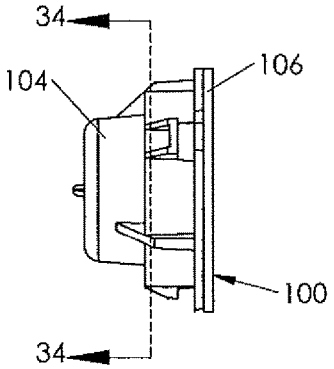
FIG. 33 is a view similar to FIG. 6, but illustrating the fifth embodiment.
Figure 34:
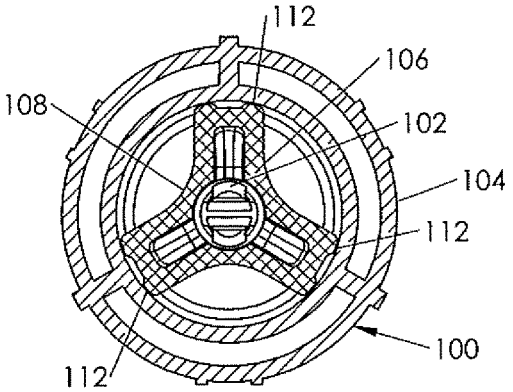
FIG. 34 is an enlarged, cross-sectional view of the fifth embodiment taken along the line 34-34 of FIG. 33.

Referring now to FIGS. 1-7, a first embodiment of the subject invention is illustrated. A roll end support plug constructed in accordance with the teachings of the present invention is identified by reference numeral 10. FIGS. 1 and 2 show the support plug 10 attached to one of the paper roll support arms 12 of a paper towel dispenser, the dispenser not being shown in its entirety and which may be of any suitable known type. FIG. 1 shows the support plug 10 inserted into the core 14 of a paper towel roll 16 comprised of toweling wound about the core in the conventional manner. The teachings of the present invention are also applicable to roll tissue products.

The support plug 10 is comprised of two plug members 18 and 20 preferably of injection molded plastic. Plug member 18 may be considered the inner plug member and the plug member 20 may be considered the outer plug member. Plug member 18 is keyed to the roll support arm 12 to prevent rotation of the plug member 18. The plug member 20 is connected to the plug member 18 to prevent axial separation, but the connection allows the plug member 20 to rotate on the plug member 18. The plug member 20 is press-fit into the toweling core 14 and rotates with the paper towel roll.

The plug member 20 is in frictional engagement with the plug member 18 to resist rotation of plug member 20 and the paper roll 16 attached thereto to prevent overspin of the paper roll when paper product is dispensed from the paper product dispenser.

Plug member 20 includes attachment structure for attaching the plug member 20 to the core of the paper roll and preventing rotation of the plug member 20 relative to the paper roll. In the arrangement illustrated, the attachment structure includes wedge-shaped members 24 which project from the central or receptacle portion 26 of the plug member 20. The wedge-shaped members 24 resist removal of the plug member 20 from the core after being inserted in place as shown in FIGS. 1 and 2, for example. Plug member 20 also includes a flat plate 28 that extends outwardly from the receptacle 26 and is in abutting engagement with the associated end of the roll product when the plug member 20 is positioned in the elongated central paper roll opening.

Plug member 18, the inner plug member, includes a flat plate 30 and a projection 32 having a horizontal bar configuration extending outwardly from the plate. The projection 32 defines a projection interior which receives an elongated horizontally disposed portion 34 of the associated support arm 12. This arrangement prevents plug member 18 from rotating relative to the support arm.

Plug member 18 additionally includes a connector element 36 extending from projection 32. The connector element 36 is of snap-in construction and has an enlarged bifurcated distal end which extends through receptacle 26 of plug member 20 and projects through an opening at the end thereof. Flat plates 28, 30 are adjacent to one another when the plug members 18, 20 are secured together. The flat plates slidably engage.

Projection 32 of plug member 18 is a generally horizontal bar having opposed lobes 40 which simultaneously engage the generally circular-shaped inner surface of receptacle 26. This provides the advantageous frictional relationship indicated above.

FIGS. 8-14 disclose a second embodiment of the invention. In this embodiment an inner plug member 50 and outer plug member 52 of support plug 54 are utilized. Support plug 54 differs from support plug 10 in that the plug member 50 is oriented vertically so that the bar-like projection 56 thereof has opposed lobes 58 at the top and bottom ends thereof. Also, in this embodiment the receptacle 60 of outer plug member 52 has a generally circular-shaped inner receptacle surface including bumps in the form of inwardly projecting spaced surface portions 62. This bump feature will slow down the rotation of the outer plug member 52 as the bumps serially engage the uppermost lobe 58. The force of gravity creates the desired friction and a small lifting of the outer plug member 52 and towel roll which slows the roll down.

FIGS. 15-21 show a third embodiment of support plug 70 which includes an inner plug member 72 and an outer plug member 74. This embodiment is similar to the embodiment shown in FIGS. 8-14, except that the bumps 76 on the inner surface of the receptacle 78 are two in number in this particular embodiment and more pronounced, i.e. the inner diameter surface is less smooth. In this embodiment the bumps make contact with the entire surface of the inner plug member 72 whereas in the second embodiment the bumps only engage the end radius of the outer plug member. Also, in this third embodiment the projection 80 has three lobes 82.

FIGS. 22-28 show a fourth embodiment of support plug 90. In this embodiment, inner plug 92 has a partial thread 94 oriented to be on the top. The outer plug member 96 has a rib 98 at the inner surface thereof which frictionally engages the partial thread.

FIGS. 29-34 show a fifth embodiment of support plug 100. In this embodiment a connector element 102 is located inside of outer plug member 104. The connector element 102 is of snap-in construction and has an enlarged bifurcated distal end which is positioned in a central opening formed in inner plug member 106 to hold the plug members together and allow rotation therebetween.

The hollow projection 108 of inner plug member 106 has three outwardly extending lobes or portions 110 having conical contact faces 112 which are in continuous contact with the conical inner surface 114 of the outer plug member. The surface 114 is smooth, continuous and free of bumps.

The invention claimed is:

1. A roll support plug connectable to a roll support structure of a paper product dispenser for supporting an end of a rotatable paper roll comprised of wound toweling or tissue defining an elongated central paper roll opening extending the length thereof, said support plug comprising, in combination:

a first plug member defining a first plug member interior for receiving the roll support structure to attach the first plug member to said roll support structure with the first plug member fixed against rotation relative to the roll support structure, said first plug member including a projection having lobes with lobe contact surfaces;

a second plug member positioned in the elongated central paper roll opening rotatably mounted on said first plug member and having a conical shaped second plug member interior surface, the lobe contact surfaces of said first plug member in frictional engagement with said conical shaped second plug interior to continuously exert a force resisting rotation of said second plug member and the paper roll attached thereto to prevent overspin of the paper roll when paper product is dispensed from the paper product dispenser, said second plug member including an attachment structure for attaching said second plug member to said paper roll and preventing rotation of said second plug member relative to said paper roll; and a connector between said plug members providing a relatively rotatable interconnection between said plug members while maintaining said plug members in frictional engagement between the lobe contact surfaces of said projection and said conical shaped plug member interior surface.

2. The roll support plug according to claim 1 wherein said paper roll includes a hollow core with toweling or tissue wound thereabout, said second plug member positionable in said hollow core, and wherein said attachment structure comprises core attachment structure for attaching said second plug member to said core for preventing rotation of said second plug member relative to said core.

3. The roll support plug according to claim 2 wherein said core attachment structure is configured to be press fit into the core.

4. The roll support plug according to claim 1 wherein said first plug member additionally includes a first flat plate adjacent to said projection and wherein said second plug member additionally includes a second flat plate adjacent to said conical shaped second plug member interior, said second flat plate in abutting engagement with an end of the roll product when said second plug member is positioned in the elongated central paper roll opening.

5. The roll support plug according to claim 4 wherein said first and second flat plates are in abutting, slidable engagement.

6. In combination:

a roll support of a paper product dispenser for supporting an end of a rotatable paper roll comprised of wound toweling or tissue defining an elongated central paper roll opening extending the length thereof;

a roll support plug including a first plug member defining a first plug member interior receiving the roll support structure and attached to the roll support structure with the first plug member fixed against rotation relative to the roll support structure, said first plug member including a projection having lobes with lobe contact surfaces, and a second plug member positioned in the elongated central paper roll opening rotatably mounted on said first plug member having a conical shaped second plug member interior surface, the lobe contact surfaces of said first plug member in frictional engagement with said first plug member to continuously exert a force resisting rotation of said second plug member and the paper roll attached thereto to prevent overspin of the paper roll when paper product is dispensed from said paper product dispenser; and a connector between said plug members providing relatively rotatable interconnection between said plug members while maintaining said plug members in frictional engagement between the lobe contact surfaces and said projection of said conical shaped second plug member interior surface.

7. The combination of claim 6 wherein said paper roll includes a hollow core with toweling or tissue wound thereabout, said second plug member positionable in said hollow core, and wherein said attachment structure comprises core attachment structure for attaching said second plug member to said core for preventing rotation of said second plug member relative to said core.

8. The combination of claim 7 wherein said core attachment structure is configured to be press fit into the core.

9. The combination of claim 6 wherein said first plug member additionally includes a first flat plate adjacent to said projection and wherein said second plug member additionally includes a second flat plate, said second flat plate adjacent to said conical shaped second plug member interior and in abutting engagement with an end of the roll product when said second plug member is positioned in the elongated central paper roll opening.

10. The combination of claim 6 wherein said first and second flat plates are in abutting, slidable engagement.

* * * * *